US007665927B2

(12) United States Patent
Bosley et al.

(10) Patent No.: US 7,665,927 B2
(45) Date of Patent: Feb. 23, 2010

(54) BEARING ASSEMBLY FOR SWIVEL JOINT

(75) Inventors: Gregg A. Bosley, Houston, TX (US); Aditya V. Soman, Houston, TX (US); David P. Ross, Katy, TX (US); James R. Streater, Jr., Humble, TX (US)

(73) Assignee: National-Oilwell DHT, L.P., Houston, TX (US)

( * ) Notice: Subject to any disclaimer, the term of this patent is extended or adjusted under 35 U.S.C. 154(b) by 188 days.

(21) Appl. No.: 11/218,258

(22) Filed: Sep. 1, 2005

(65) Prior Publication Data

US 2007/0044448 A1 Mar. 1, 2007

(51) Int. Cl.
*F16C 11/00* (2006.01)

(52) U.S. Cl. ..... 403/135; 403/78; 166/301; 294/86.1; 29/898.043; 384/499; 384/502

(58) Field of Classification Search ..... 403/135–138, 403/141–144, 135–38; 166/301; 294/86.1; 384/615, 499, 501, 502, 609, 617; 29/898.04, 29/898.043, 898.07, 898.1, 898.11, 441.1; 464/141–143, 906

See application file for complete search history.

(56) References Cited

U.S. PATENT DOCUMENTS 1,532,743 A * 4/1925 Hadsel ..... 464/140
1,861,364 A * 5/1932 Schreck ..... 464/140
2,356,351 A * 8/1944 Phillips ..... 285/41
2,656,012 A * 10/1953 Thorpe ..... 184/5.1
2,874,780 A * 2/1959 Gertzen ..... 166/105.5
2,884,073 A * 4/1959 Bostock et al. ..... 166/217
2,963,304 A * 12/1960 Comlossy, Jr. et al. ..... 285/98
3,186,189 A * 6/1965 Cull ..... 464/145
3,264,006 A * 8/1966 Downs ..... 285/276
3,336,057 A * 8/1967 Bloomquist ..... 285/276
4,128,127 A * 12/1978 Taylor ..... 166/105
4,378,839 A * 4/1983 Fisher, Jr. ..... 166/217
4,904,228 A * 2/1990 Frear et al. ..... 464/152
5,468,153 A * 11/1995 Brown et al. ..... 439/13
7,217,056 B2 * 5/2007 Cooper ..... 403/35

OTHER PUBLICATIONS

Joe DeGeare, David Haughton, Mark McGurk, The Guide to Oilwell Fishing Operation.
Gulf Publishing Company, Oilwell Fishing Operations: Tools and Techniques, Aug. 1990.
Gunn Wireline, Wireline Tools.
National Oilwell, Cable Guided & Side Door Fishing Methods, 2004.

* cited by examiner

*Primary Examiner*—Daniel P Stodola
*Assistant Examiner*—Nahid Amiri
(74) *Attorney, Agent, or Firm*—Howrey LLP

(57) ABSTRACT

The present invention is an improved swivel joint for use as part of a cable-guided fishing assembly. The swivel joint contains a bearing assembly comprising a series of ball bearings partially encased by an inner and outer race. During a cable-guided fishing operation, the inner and outer race exert a shearing, rather than compression, force on the ball bearing due to the unique configuration of the bearing assembly. This unique configuration increases the strength of the bearing assembly, and the corresponding strength of the swivel joint, without necessitating an increase in the outer diameter of the swivel joint.

17 Claims, 4 Drawing Sheets

BEARING ASSEMBLY FOR SWIVEL JOINT

FIELD OF THE INVENTION

The present invention generally relates to equipment used for removing downhole tools that are stuck in an oil or gas well. In particular, the present invention relates to an improved swivel joint for use as part of a cable-guided fishing assembly used to remove downhole tools that have become stuck in an oil or gas well.

BACKGROUND OF THE INVENTION

There are various methods of completion and production in relation to an oil or gas well. Typically, an oil or gas well is completed by cementing casing strings in place along substantially the entire depth of the well. Once the well is completed, production can commence. To facilitate the production of hydrocarbons or other fluids from the well, production tubing is typically installed within the cased wellbore. Production tubing is set in a portion of the well generally concentric with the casing. The production tubing allows communication of the producing zone of the well with the surface.

After the casing and production tubing are installed in the well, there is often the need for various procedures to be performed on the well, such as perforating the well, well logging operations, and the like. These procedures are performed with tools that are typically attached to what is known as a wireline. The wireline is essentially a metallic, braided cable with a plurality of electrical conductors contained therein, or is often just a metallic braided cable. The various tools that are to be used for a given operation are lowered into the well on the end of the wireline and then activated and/or monitored at the surface by an operator. When operations with the tools are complete, the wireline and attached tools are pulled to the surface and removed from the well so that production can commence or resume, or so that further operations can be conducted in the well.

Occasionally, downhole tools become stuck in the well during the retrieval process. Downhole tools can become stuck in a well for various reasons, such as encountering a restriction that has formed in the inner diameter of the wellbore. Additionally, downhole tools sometimes become bridged over, or the line on which the tools are run becomes key-seated in the walls of the well bore, thereby hindering or preventing removal of the tools from the well. Often, these downhole tools are very expensive pieces of electronic instrumentation and/or have radioactive sources contained therein, and, thus, they must be retrieved. Moreover, these tools often present a hindrance to further operations in or production from the well and therefore they must be removed from the well. The procedure of retrieving a stuck tool is typically known as "fishing."

For situations in which the stuck tool is still attached to an intact wireline, either a cable-guided fishing method (also known as the "cut and strip" method) or a side-door overshot method is typically used to retrieve the tool. The cable-guided fishing method is typically used for deep, open-hole situations or when a radioactive instrument is stuck in the hole. For these situations, the cable-guided fishing method is a safe method that offers a high probability of success. In particular, the cable-guided fishing method allows retrieval of the stuck tool while the tool remains attached to the cable, thereby minimizing or removing the possibility that the tool will fall down the well during the fishing operation and allowing for the well bore to be cleared with a minimum of downtime.

Further, in some instances, through the use of the cable-guided fishing method, the expensive multi-conductor cable can be salvaged.

The cable-guided fishing method is performed with a special set of tools, hereinafter referred to as the "fishing assembly." An example of a prior art fishing assembly is shown in FIG. 1. The fishing assembly typically comprises a cable hanger (A) with a T-bar, a spearhead rope socket (B), a rope socket (C), one or more sinker bars (D), a spearhead overshot (E), and a "C" plate (F). In operation, the fishing assembly fishes the stuck tool out of the well in a series of steps. Specifically, the following steps are typical of the operation of the fishing assembly (refer to FIG. 2 for a depiction of the individual components of the fishing assembly in their relative positions during operation):

(1) the spear head overshot (E) is disconnected from the spear head rope socket (B) and raised up to the derrick man;

(2) the derrick man will then thread the spear head overshot (E) and sinker bar (D) through the first stand of pipe (G) to be run into the well as part of the fishing operation;

(3) the driller will then pick up the first stand of pipe (G) and suspend it over the well head;

(4) the spear head overshot (E) should then be connected to the spear head rope socket (B), a light strain taken on the cable, and the "C" Plate (F in FIG. 1) removed;

(5) the first stand of pipe (G) is then run in the well bore and the slips (H) are set;

(6) the "C" Plate is then replaced, and the assembly is allowed to rest on the tool joint;

(7) the spear head overshot (E) is then disconnected and raised back up to the derrick man;

(8) the derrick man threads the spear head overshot (E) and sinker bar (D) through the next stand of pipe (I), which in turn is picked up by the driller and suspended over the well head through use of the rig's elevator (J);

(9) the spear head overshot (E) is connected to the spear head rope socket (B), the "C" Plate is removed, and the second stand of pipe (I) is stabbed into and made up to the first stand of pipe (G) and run into the well bore;

(10) the "C" Plate is replaced, the spear head overshot (E) is again disconnected and raised up to the derrick man, and the procedure is repeated until enough pipe has been run into the well to contact and free the stuck tool;

(11) after the fish has been contacted and pulled free, the cable hanger (A in FIG. 1) is again placed on the cable, the rope sockets (B, C) are removed from the cable, and the cable tied together;

(12) the elevator (J) is then latched around the "T" bar on the cable hanger, and a strain sufficient to pull the cable out of the tool is taken;

(13) the cable hanger is then removed, and the free cable is spooled on to a service truck reel;

(14) the fishing string along with the fish may then be pulled from the hole in the conventional manner.

In addition to these components, the fishing assembly may also include a knuckle joint, a swivel joint, or a knuckle/swivel combination joint. A swivel joint of the prior art is shown in FIG. 3. The knuckle/swivel joint (either alone or in combination) is typically located between the spear head overshot and the sinker bar, but may be additionally located throughout the fishing assembly.

Referring to the two joints independently, the knuckle joint allows the fishing assembly to angularly shift or bend, thereby allowing the fishing assembly to maneuver through turns or curves as it is lowered and raised in the wellbore. In comparison, the swivel joint (and specifically the bearing assembly within the swivel joint) allows the fishing assembly below the swivel to effectively rotate or swivel, thereby relieving any torque in the fishing cable or assembly that may be built up during the fishing process. As noted above, the knuckle joint and swivel joint may be placed independently in the fishing assembly, or may be combined into one, multipurpose joint.

While prior art knuckle/swivel joints have been successfully used for many years, there are some inherent limitations associated with the prior art design. For example, the swivel joint as shown in FIG. 3 typically has a maximum tensile strength rating of only 12,000 lbs. This rating typically cannot be increased without similarly increasing the outer diameter of the swivel joint (i.e., increasing the size of the swivel joint in order to increase the tensile strength). As one of skill in the art will recognize, the outer diameter of any component of the fishing assembly is limited by the inner diameter of the tubing in which it is placed. Furthermore, referring to combination knuckle/swivel joints, it is difficult to effectively seal the bearing assembly against well fluid and mud. These contaminants negatively affect the swivel joint's ability to "swivel," thereby negatively affecting the swivel joint's ability to relieve built-up torque in the fishing cable and assembly.

Accordingly, the following improved swivel joint allows for increased tensile strength without increasing the outer diameter of the joint, and further allows for the bearing assembly to be effectively sealed against well fluid and mud.

SUMMARY OF THE INVENTION

This invention relates to an improved swivel joint for use as part of a cable-guided fishing assembly. In a preferred embodiment of the present invention, the swivel joint comprises a hollow lower sub. The inner diameter of the lower sub includes a female threaded section that allows the lower sub to be threadably connected to additional components in the fishing assembly. The upper end of the lower sub is connected to a hollow bearing housing. Located within and extending between the lower sub and the bearing housing, is a ball joint. While located directly adjacent to the lower sub and the bearing housing, the ball joint is not physically attached to either.

The lower portion of the ball joint includes a centrally located recess, which corresponds to an implanted grease fitting. The grease fitting recess, and correspondingly the grease fitting, are in fluid communication with a grease port that extends through the ball joint and runs perpendicular to the longitudinal axis of the swivel joint. Located between the lower sub and the ball joint is a lower sealing device. Similarly, located between the bearing housing and the ball joint is an upper sealing device. The aforementioned grease fitting and the grease port cooperate to keep the bearing assembly lubricated. Moreover, the lower and upper sealing devices keep the grease localized in the bearing assembly, and also prevent unwanted well fluid and/or mud from entering the assembly.

Located between the ball joint and the lower sub is a series of ball bearings. The ball bearings are specifically located between an arcuate portion of a recess in the outer diameter of the ball joint and an upper arcuate lip of the lower sub. Adjacent to the lower portion of the ball bearings, and located against a shoulder portion of the recess in the outer diameter of the ball joint, is an inner race. Conversely, adjacent to the upper portion of the ball bearings, and located against an inner shoulder of the bearing housing, is an outer race. While the inner race is located directly adjacent to the lower sub and the bearing housing, the inner race is not physically attached to either. Likewise, while the outer race is located directly adjacent to the bearing housing and the ball joint, the outer race is not physically attached to either.

The races are essentially small circular inserts on which the ball bearings rotate and spin. The races are strategically placed against the ball bearings. The inner diameter of the inner race extends downward on a tangential line from the innermost points of the ball bearings. Conversely, the outer diameter of the inner race extends downward from the centerlines of the ball bearings. The outer race is effectively the opposite, with the inner diameter of the outer race extending upward from the centerlines of the ball bearings, and the outer diameter of the outer race extending upward on a tangential line from the outermost points of the ball bearings. The ball bearings and the corresponding races are referred to herein as the "bearing assembly."

Moving upward along the swivel joint, the upper portion of the ball joint is spherically shaped. The spherically shaped upper portion is located within a correspondingly spherically shaped recess formed by the connection of a lower socket to an upper socket. The placement of the upper portion of the ball joint within the lower socket and upper socket effectively forms the knuckle joint referenced previously. As opposed to the prior art knuckle/swivel combination joint, the swivel joint of the present invention is separated from the knuckle joint. Lastly, the outer diameter of the upper portion of the upper socket includes a male threaded section that allows the upper socket to be threadably connected to additional components in the fishing assembly.

In a typical fishing operation, a tensile force is exerted on the swivel joint. As noted above, the ball joint is not physically attached to either the lower sub or the bearing housing. Rather, the ball joint is held in place only by the placement of the ball bearings in conjunction with the inner and outer races. As the tensile force is exerted on the swivel joint, that load is directed to the de facto attachment point of the ball joint—namely, the ball bearings and races. Due to the unique placement of the respective races, the tensile force acting on the ball joint is transformed into a shearing force acting on the ball bearings.

Specifically, the inner race abuts the ball joint and the outer race abuts the bearing housing. As the ball joint and bearing housing are effectively pulled apart (i.e. put in tension), the opposing races are pushed together (i.e., put in compression). The compression of the inner race and outer race towards each other exerts a shearing force on the corresponding ball bearings because the outer diameter of the inner race is aligned with the longitudinal centerlines of the ball bearings extending downward, while the inner diameter of the outer race is aligned with the longitudinal centerlines of the ball bearings extending upward. Accordingly, the shearing force is directed through the longitudinal centerlines of the ball bearing.

Locating the corresponding races such that ball bearings are placed in shear, coupled with the use of high strength ball bearings, increases the strength of the bearing assembly, which increases the overall tensile strength of the swivel joint. As opposed to the prior art, this increase in strength is accomplished without increasing the overall diameter of the swivel joint.

Additional objects and advantages of the invention will become apparent as the following detailed description of the preferred embodiment is read in conjunction with the drawings.

BRIEF DESCRIPTION OF THE DRAWINGS

The following figures form part of the present specification and are included to further demonstrate certain aspects of the present invention. The invention may be better understood by reference to one or more of these figures in combination with the detailed description of the specific embodiment presented herein.

DESCRIPTION OF ILLUSTRATIVE EMBODIMENTS

The following example is included to demonstrate a preferred embodiment of the present invention. It should be appreciated by those of skill in the art that the description that follows represents techniques discovered by the inventors to function well in the practice of the invention, and thus can be considered to constitute a preferred mode for its practice. However, those of skill in the art should, in light of the present disclosure, appreciate that many changes can be made in the specific embodiment which is disclosed and still obtain a like or similar result without departing from the spirit and scope of the invention.

Figure 4:
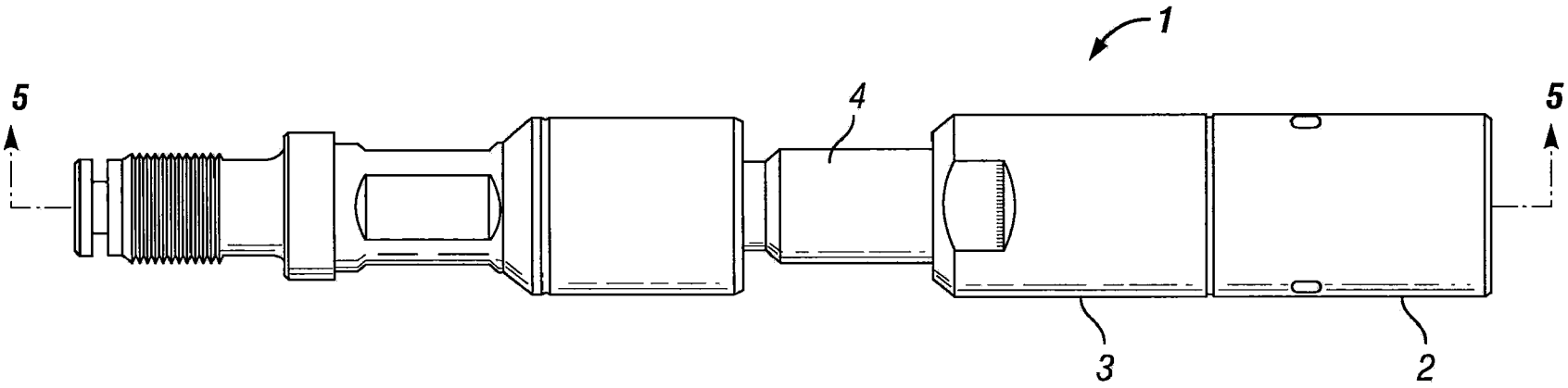
FIG. 4 is a side view of the swivel joint of the present invention.
Figure 5:
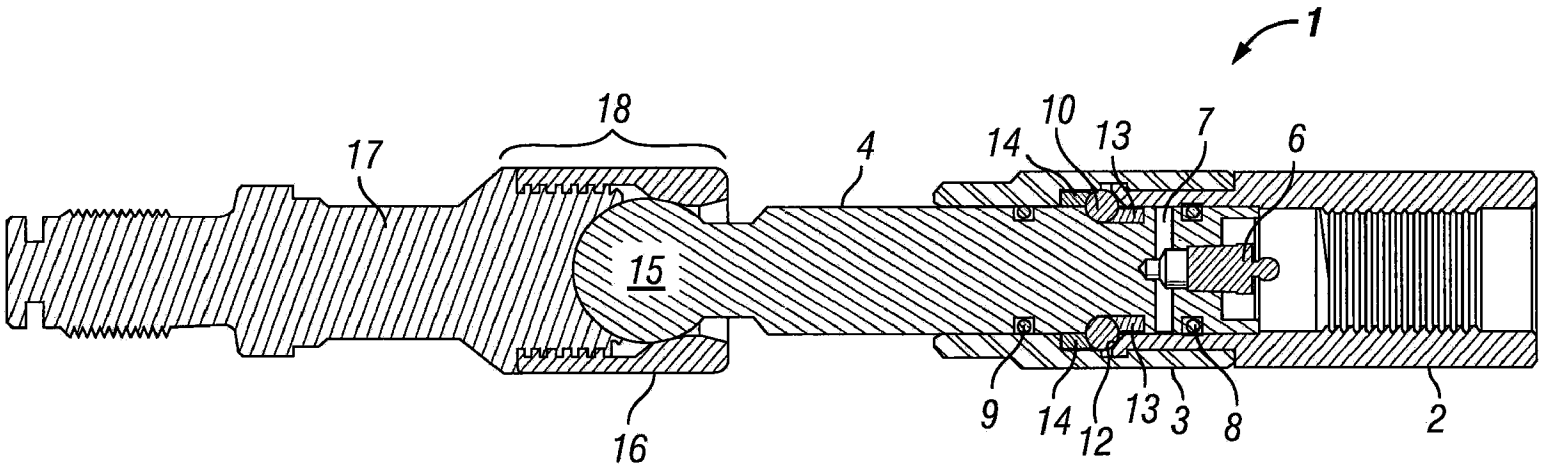
FIG. 5 is a cross-sectional view of the swivel joint of the present invention viewed along the line 5-5 as shown in FIG. 4.

FIGS. 4 through 7 illustrate a preferred embodiment of the swivel joint of the present invention. Unless otherwise specified, the swivel joint is preferably comprised of steel; however, any material capable of withstanding the significant forces imposed on the swivel joint during operation may be used. Referring specifically to FIGS. 4 and 5, the swivel joint (1) comprises a hollow lower sub (2). The inner diameter of the lower sub (2) includes a female threaded section that allows the lower sub (2) to be threadably connected to additional components in the fishing assembly (not shown). The upper end of the lower sub (2) is connected to a hollow bearing housing (3). Although a threaded connection is preferred, any suitable connection means may be used to connect the lower sub (2) to the bearing housing (3).

Figure 7:
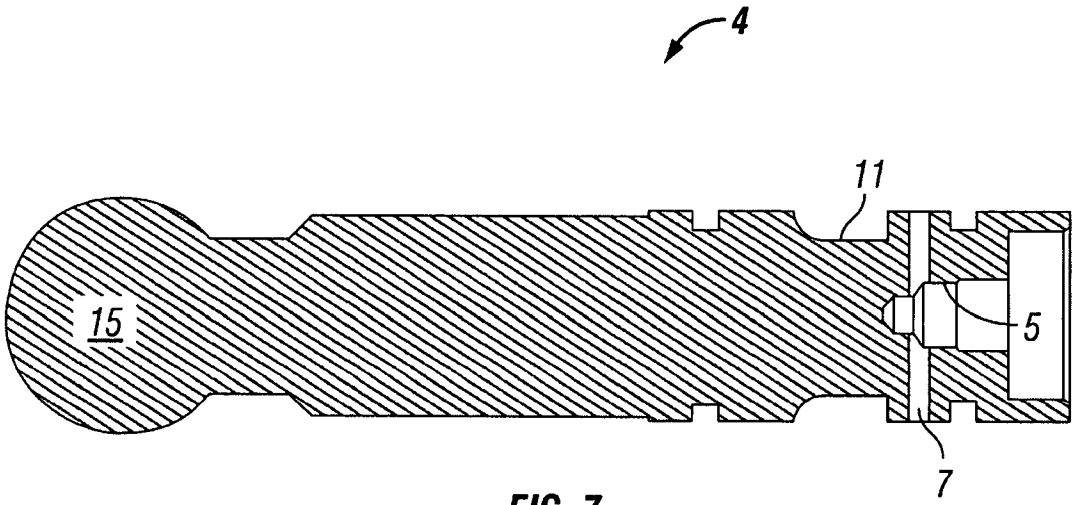
FIG. 7 is a cross-sectional view of the ball joint component of the swivel joint of the present invention viewed along the line 7-7 shown in FIG. 6.

Located within and extending between the lower sub (2) and the bearing housing (3), is a ball joint (4). While located directly adjacent to the lower sub (2) and the bearing housing (3), the ball joint (4) is not physically attached to either. As best shown in FIG. 7, the lower portion of the ball joint (4) includes a centrally located recess (5), which corresponds to an implanted grease fitting (6) (shown in FIG. 5). The grease fitting recess (5), and correspondingly the grease fitting (6), are in fluid communication with a grease port (7) that extends through the ball joint (4) and runs perpendicular to the longitudinal axis of the swivel joint (1).

Referring again to FIG. 5, located between the lower sub (2) and the ball joint (4) is a lower sealing device (8), such as an O-ring or similar sealing mechanism. Similarly, located between the bearing housing (3) and the ball joint (4) is an upper sealing device (9), which may also be an O-ring or similar sealing mechanism. The aforementioned grease fitting (6) and the grease port (7) cooperate to keep the bearing assembly (which will be discussed below) lubricated. Moreover, the lower and upper sealing devices (8,9) keep the grease localized in the bearing assembly, and also prevent unwanted well fluid and/or mud from entering the bearing assembly.

Located between the ball joint (4) and the lower sub (2) is a series of ball bearings (10). The series of ball bearings (10) preferably number twelve, however any suitable number of ball bearings (10) may be used. The ball bearings (10) are specifically located between an arcuate portion of a recess (11) in the outer diameter of the ball joint (4) (best shown in FIG. 7), and an upper arcuate lip (12) of the lower sub (2). The ball bearings are preferably 0.281 inches in diameter and composed of a high strength material, such as 250,000 to 300,000 psi stainless steel. While this size and material are preferred, any suitable size and high strength material may be used provided the ball bearing is capable of handling the high shear forces acting on the ball bearings during operation. Adjacent to the lower portion of the ball bearings (10), and located against a shoulder portion of the recess (11) in the outer diameter of the ball joint (4), is an inner race (13). Conversely, adjacent to the upper portion of the ball bearings (10), and located against an inner shoulder of the bearing housing (3), is an outer race (14). While the inner race (13) is located directly adjacent to the lower sub (2) and the bearing housing (3), the inner race (13) is not physically attached to either. Likewise, while the outer race (14) is located directly adjacent to the bearing housing (3) and the ball joint (4), the outer race (14) is not physically attached to either.

The races (13,14) are essentially small circular inserts on which the ball bearings (10) rotate and spin. The races (13,14) are preferably comprised of hardened tool steel, able to withstand compression against the high strength ball bearings (10) without yielding material. While hardened tool steel is preferred, any suitable high strength material may be used. The races (13,14) are strategically placed against the ball bearings (10). The inner diameter of the inner race (13) extends downward on a tangential line from the innermost points of the ball bearings (10). Conversely, the outer diameter of the inner race (13) extends downward from the longitudinal centerlines of the ball bearings (10). The outer race (14) is effectively the opposite, with the inner diameter of the outer race (14) extending upward from the longitudinal centerlines of the ball bearings (10), and the outer diameter of the outer race (14) extending upward on a tangential line from the outermost points of the ball bearings (10).

Figure 1:
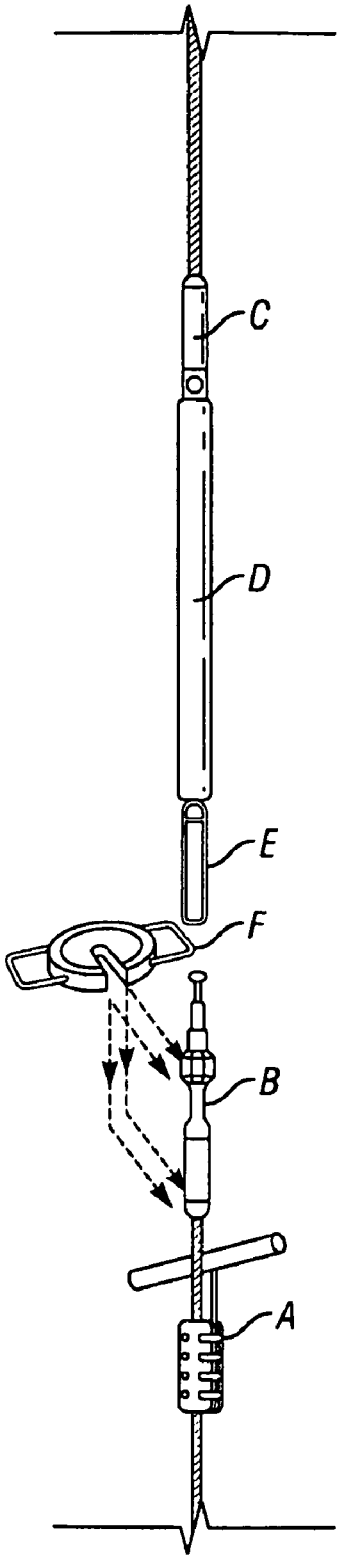
FIG. 1 (Prior Art)
FIG. 1 is a side view of a typical cable-guided fishing assembly showing the various components of such assembly in their respective positions.
Figure 2:
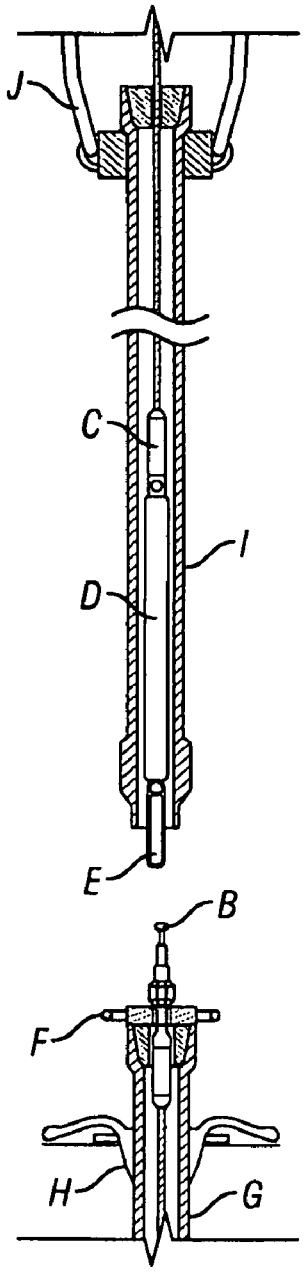
FIG. 2 (Prior Art)
FIG. 2 is a side view of a typical cable-guided fishing assembly showing the various components of such assembly in their respective positions within tubular members during operation.
Figure 3:
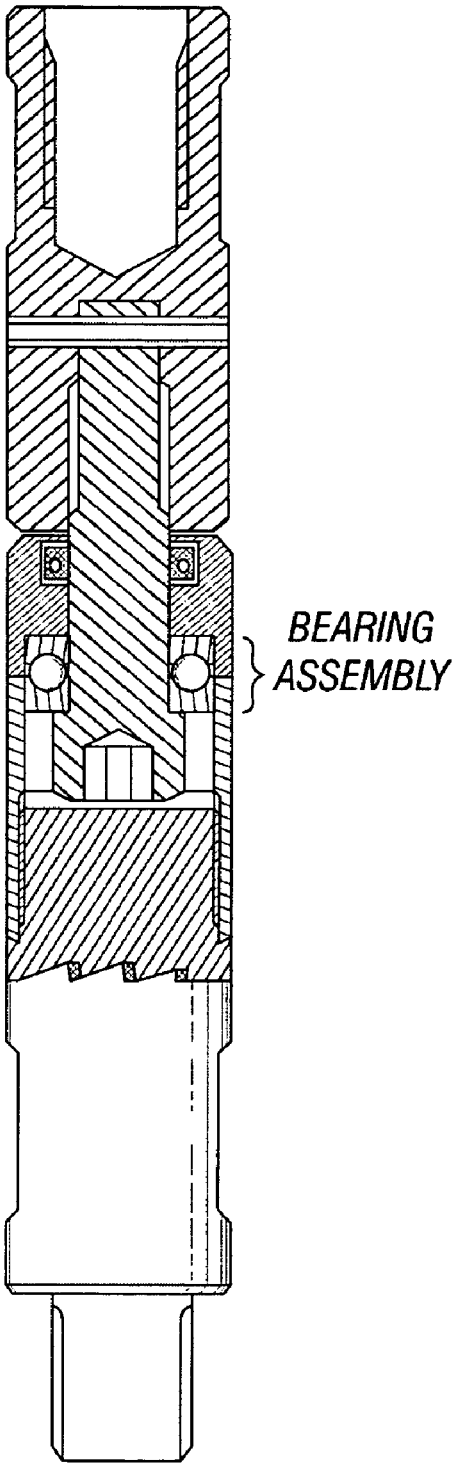
FIG. 3 (Prior Art)
FIG. 3 is a cross sectional view of a prior art swivel joint.
Figure 6:
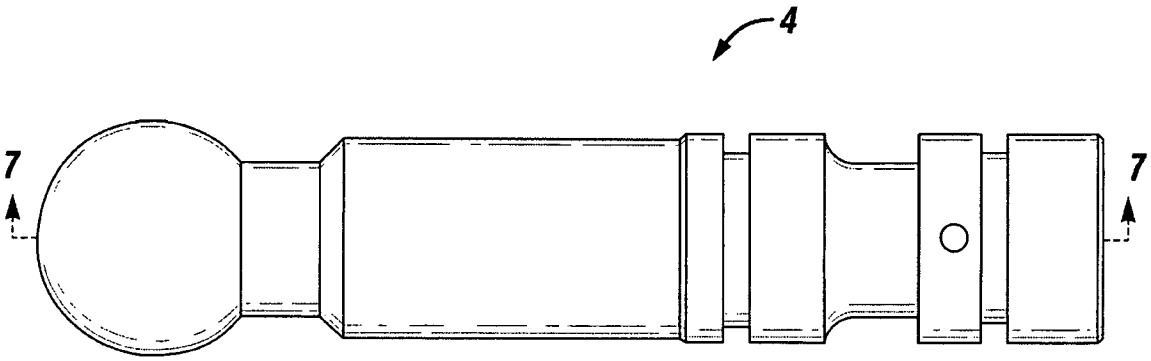
FIG. 6 is a side view of the ball joint component of the swivel joint of the present invention

Moving upward along the swivel joint (1), the upper portion (15) of the ball joint (4) is spherically shaped (as shown best in FIGS. 5 through 7). The spherically shaped upper portion (15) is located within a correspondingly spherically shaped recess formed by the connection of a lower socket (16) to an upper socket (17). Although a threaded connection is preferred, any suitable connection means may be used to secure the lower socket (16) to the upper socket (17). The placement of the upper portion (15) of the ball joint (4) within the lower socket (16) and upper socket (17) effectively forms the knuckle joint (18) referenced previously. As opposed to the prior art knuckle/swivel combination joint (as shown in FIG. 3), the swivel joint (1) of the present invention is separated from the knuckle joint (18) (as shown in FIG. 5). Lastly, the outer diameter of the upper portion of the upper socket (17) includes a male threaded section that allows the upper socket (17), and correspondingly the swivel joint (1), to be threadably connected to additional components in the fishing assembly (not shown).

In a typical fishing operation, such as the one described in the BACKGROUND section above, a tensile force is exerted on the swivel joint (1). As noted above, the ball joint (4) is not physically attached to either the lower sub (2) or the bearing housing (3). Rather, the ball joint (4) is held in place only by the placement of the ball bearings (10) in conjunction with the inner and outer races (13,14). As the tensile force is exerted on the swivel joint, that load is directed specifically to the de facto attachment point of the ball joint (4)—namely, the ball bearings (10) and races (13,14). Due to the unique placement of the respective races (13,14), the tensile force acting on the ball joint (4) is transformed into a shearing force acting on the ball bearings (10).

Specifically, the inner race (13) abuts the ball joint (4) and the outer race (14) abuts the bearing housing (3). As the ball joint (4) and bearing housing (3) are effectively pulled apart (i.e. put in tension), the opposing races (13,14) are pushed together (i.e., put in compression). The compression of the inner race (13) and outer race (14) towards each other exerts a shearing force on the corresponding ball bearings (10) because the outer diameter of the inner race (13) is aligned with the longitudinal centerlines of the ball bearings (10) extending downward, while the inner diameter of the outer race (14) is aligned with the longitudinal centerlines of the ball bearings (10) extending upward. Accordingly, the shearing force is directed through the longitudinal centerlines of the ball bearing (10).

Locating the corresponding races (13,14) such that ball bearings (10) are placed in shear, coupled with the use of high strength ball bearings (10), increases the strength of the bearing assembly, which increases the overall tensile strength of the swivel joint (1). The swivel joint (1) of the present invention is able to withstand a tensile force of approximately 75,000 lbs., and may be rated to approximately 25,000 lbs., more than twice that of typical prior art devices. Because of the unique design of the bearing assembly, the outer diameter of the swivel joint (1) need not be increased to accomplish this increase in strength.

While this invention has been described in terms of a preferred embodiment, it will be apparent to those of skill in the art that variations may be applied to the apparatus and method described herein without departing from the concept and scope of the invention. All such similar substitutes and modifications apparent to those skilled in the art are deemed to be within the scope and concept of the invention as it is set out in the following claims.

The invention claimed is:

1. A swivel joint for use as part of a cable-guided fishing assembly, the swivel joint comprising:

a ball joint;

a lower sub;

a bearing assembly located between the ball joint and the lower sub, the bearing assembly allowing the lower sub to rotate, the bearing assembly comprising:

at least one ball bearing;

a circular inner race insert capable of withstanding compression against the ball bearing without yield, the inner race insert being adjacent to the at least one ball bearing, the inner race insert positioned such that the outer diameter of the inner race insert is aligned with the longitudinal center axis of the at least one ball bearing, and the inner diameter of the inner race insert is aligned with a tangential line extending from the innermost point of the at least one ball bearing; and a circular outer race insert capable of withstanding compression against the ball bearing without yield, the outer race insert being adjacent to the at least one ball bearing, the outer race insert positioned such that the inner diameter of the outer race insert is aligned with the longitudinal center axis of the at least one ball bearing, and the outer diameter of the outer race insert is aligned with a tangential line extending from the outermost point of the at least one ball bearing, wherein the inner race insert and the outer race insert exert a shearing force on the ball bearing when a tensile force is exerted on the swivel joint.

2. The swivel joint of claim 1, further comprising a grease fitting in fluid communication with the at least one ball bearing.

3. The swivel joint of claim 1, further comprising at least one sealing device capable of isolating the at least one ball bearing from well fluids.

4. The swivel joint of claim 1 wherein the at least one ball bearing comprises twelve ball bearings.

5. The swivel joint of claim 1 wherein the at least one ball bearing has a yield strength of at least 250,000 psi.

6. The swivel joint of claim 1 wherein the at least one ball bearing has a diameter of 0.281 inches.

7. The swivel joint of claim 1 wherein the swivel joint has a tensile rating of up to 75,000 lbs.

8. A method of constructing a swivel joint for use as part of a cable-guided fishing assembly, the method comprising:

providing at least one ball bearing;

locating a circular inner race insert capable of withstanding compression against the ball bearing without yield adjacent to the at least one ball bearing such that the outer diameter of the inner race insert is aligned with the longitudinal center axis of the at least one ball bearing, and the inner diameter of the inner race insert is aligned with a tangential line extending from the innermost point of the at least one ball bearing; and locating a circular outer race insert capable of withstanding compression against the ball bearing without yield adjacent to the at least one ball bearing such that the inner diameter of the outer race insert is aligned with the longitudinal center axis of the at least one ball bearing, and the outer diameter of the outer race insert is aligned with a tangential line extending from the outermost point of the at least one ball bearing, wherein the inner race insert and the outer race insert exert a shearing force on the ball bearing when a tensile force is exerted on the swivel joint.

9. The method of claim 8 further comprising locating a grease fitting in fluid communication with the at least one ball bearing.

10. The method of claim 8 further comprising locating at least one sealing device capable of isolating the at least one ball bearing from well fluids.

11. The method of claim 8 wherein the step of providing at least one ball bearing further comprises providing twelve ball bearings.

12. The method of claim 8 wherein the step of providing at least one ball bearing further comprises providing at least one ball bearing having a yield strength of at least 250,000 psi.

13. The method of claim 8 wherein the step of providing at least one ball bearing further comprises providing at least one ball bearing having a diameter of 0.281 inches.

14. A knuckle and swivel assembly for use as part of a cable-guided fishing assembly, the knuckle and swivel assembly comprising:

a swivel joint comprising at least one ball bearing; a circular inner race insert capable of withstanding compression against the ball bearing without yield, the inner race insert being adjacent to the at least one ball bearing, the inner race insert positioned such that the outer diameter of the inner race insert is aligned with the longitudinal center axis of the at least one ball bearing, and the inner diameter of the inner race insert is aligned with a tangential line extending from the innermost point of the at least one ball bearing; and a circular outer race insert capable of withstanding compression against the ball bearing without yield, the outer race insert being adjacent to the at least one ball bearing, the outer race insert positioned such that the inner diameter of the outer race insert is aligned with the longitudinal center axis of the at least one ball bearing, and the outer diameter of the outer race insert is aligned with a tangential line extending from the outermost point of the at least one ball bearing, wherein the inner race insert and the outer race insert exert a shearing force on the ball bearing when a tensile force is exerted on the swivel joint; and a knuckle joint connected to the swivel joint.

15. The knuckle and swivel assembly of claim 14 wherein the at least one ball bearing is isolated from well fluids.

16. The method of claim 14, further comprising the step of isolating the at least one ball bearing from well fluids.

17. A method of constructing a knuckle and swivel assembly for use as part of a cable-guided fishing assembly, the method comprising:

providing a swivel joint comprising at least one ball bearing; an circular inner race insert capable of withstanding compression against the ball bearing without yield, the inner race insert being adjacent to the at least one ball bearing such that the outer diameter of the inner race insert is aligned with the longitudinal center axis of the at least one ball bearing, and the inner diameter of the inner race insert is aligned with a tangential line extending from the innermost point of the at least one ball bearing; and a circular outer race insert capable of withstanding compression against the ball bearing without yield, the outer race insert being adjacent to the at least one ball bearing such that the inner diameter of the outer race insert is aligned with the longitudinal center axis of the at least one ball bearing, and the outer diameter of the outer race insert is aligned with a tangential line extending from the outermost point of the at least one ball bearing, wherein the inner race insert and the outer race insert exert a shearing force on the ball bearing when a tensile force is exerted on the swivel joint; and connecting a knuckle joint to the swivel joint.

* * * * *

UNITED STATES PATENT AND TRADEMARK OFFICE

CERTIFICATE OF CORRECTION

PATENT NO. : 7,665,927 B2
APPLICATION NO. : 11/218258
DATED : February 23, 2010
INVENTOR(S) : Bosley et al.

It is certified that error appears in the above-identified patent and that said Letters Patent is hereby corrected as shown below:

Column 10, Line 7: remove "an" and insert --a--

Signed and Sealed this

Eighteenth Day of May, 2010

David J. Kappos

David J. Kappos
*Director of the United States Patent and Trademark Office*